US008628218B2

(12) United States Patent
Yu et al.

(10) Patent No.: US 8,628,218 B2
(45) Date of Patent: Jan. 14, 2014

(54) LAMP INCORPORATING SUPPORTING BODY FOR EASILY MOUNTING TO A SUPPORT

(75) Inventors: Guang Yu, Foshan (CN); Qian Xiang, Foshan (CN)

(73) Assignees: Champ Tech Optical (Foshan) Corporation, Forshan (CN); Foxconn Technology Co., Ltd., New Taipei (TW)

( * ) Notice: Subject to any disclaimer, the term of this patent is extended or adjusted under 35 U.S.C. 154(b) by 77 days.

(21) Appl. No.: 13/457,556

(22) Filed: Apr. 27, 2012

(65) Prior Publication Data

US 2013/0128578 A1 May 23, 2013

(30) Foreign Application Priority Data

Nov. 17, 2011 (CN) ..... 2011 1 0365222

(51) Int. Cl.
*F21V 29/00* (2006.01)
*F21V 21/00* (2006.01)

(52) U.S. Cl.
USPC ..... 362/294; 362/373; 362/374

(58) Field of Classification Search
USPC ..... 362/249.02, 294, 373, 368, 374, 375, 362/457
See application file for complete search history.

(56) References Cited

U.S. PATENT DOCUMENTS

| | | | | |
|---|---|---|---|---|
| 5,420,762 | A * | 5/1995 | Lewis | 362/368 |
| 2007/0183160 | A1 * | 8/2007 | Tufano et al. | 362/457 |
| 2010/0208473 | A1 * | 8/2010 | Sakai et al. | 362/373 |
| 2012/0314429 | A1 * | 12/2012 | Plunk | 362/374 |

* cited by examiner

*Primary Examiner* — Y My Quach Lee
(74) *Attorney, Agent, or Firm* — Altis Law Group, Inc.

(57) ABSTRACT

A lamp includes a supporting body and a lamp body. The supporting body is fixed to a support such as a ceiling. The supporting body defines a plurality of apertures each including a hole and a slot. The slot has a width less than a diameter of the hole. The lamp body includes a housing, a heat sink, a light source and a cover. The housing forms a plurality of protrusions each including a pole and a head. The head has a diameter larger than a width of the slot. The protrusions extend through the holes of the apertures and then are rotated into the slots, whereby the heads are located above the slots and engage with the supporting body. Thus, the lamp is suspended from the support. A resilient member is provided between the housing and the supporting body.

18 Claims, 6 Drawing Sheets

LAMP INCORPORATING SUPPORTING BODY FOR EASILY MOUNTING TO A SUPPORT

BACKGROUND

1. Technical Field

The present disclosure relates to lamps, and more particularly, to an LED (light emitting diode) lamp incorporating a detachable lamp body for easily mounting the lamp to a support such as a ceiling.

2. Description of Related Art

Lamps include many different types depending on the actual occasions to be applied, such as ceiling lamps, wall lamps, road lamps, traffic lamps, desktop lamps and so on. A conventional ceiling lamp often includes a lampshade, a light source received in the lampshade and a cover mounted to the lampshade to cover the light source. The ceiling lamp is fixed to a ceiling via a plurality of screws. In assembly, the ceiling lamp should be lifted to abut against the ceiling and then held for a time for manipulating the screws to extend through the lamp into the ceiling. However, if the lamp is heavy, the holding of the lamp needs a great effort during assembly of the screws one by one. Therefore, the assembly of the ceiling lamp to the ceiling is inconvenient.

What is needed, therefore, is a lamp which can overcome the limitations described above.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
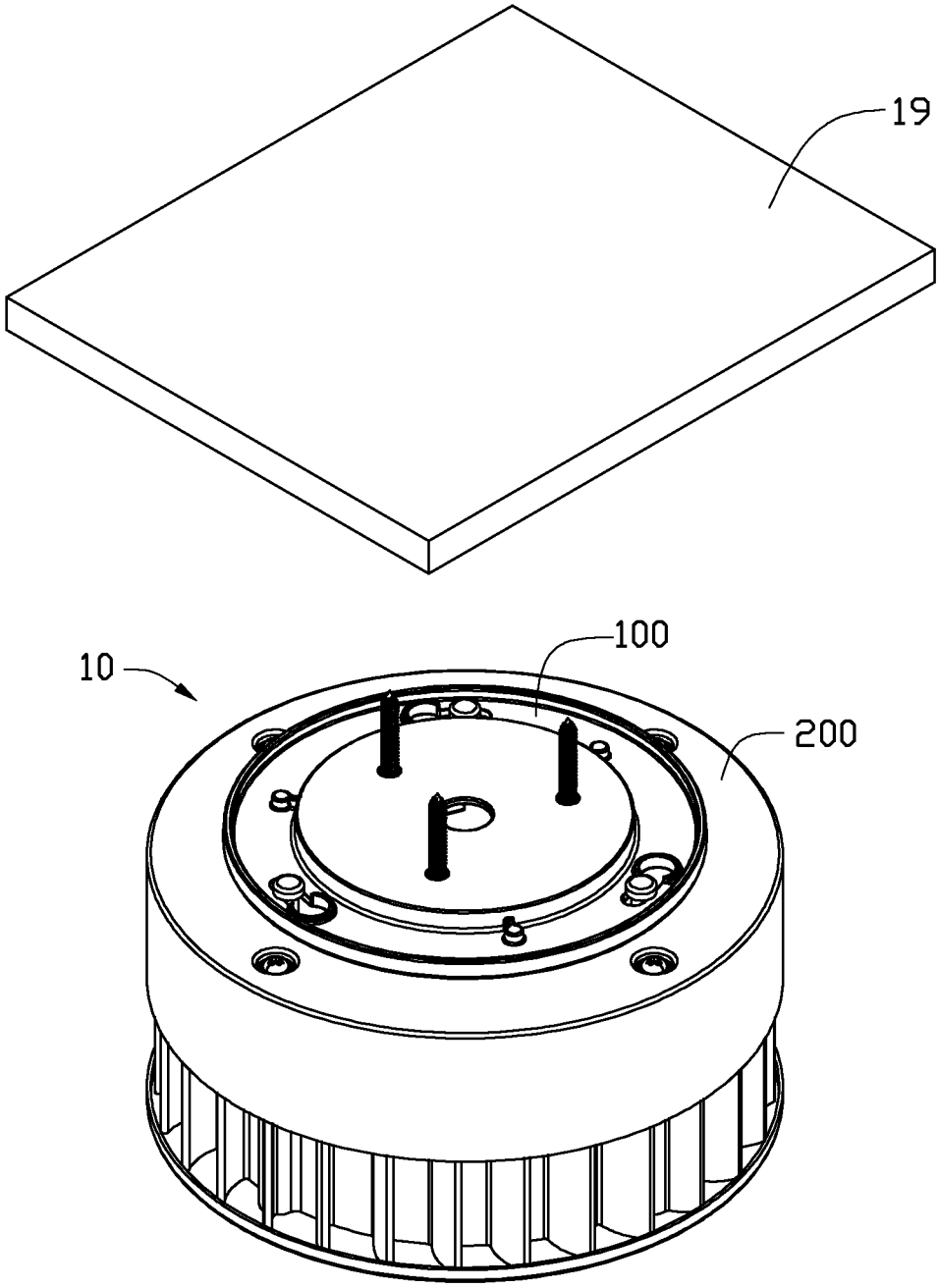
FIG. 1 is an isometric, assembled view of a lamp in accordance with an embodiment of the present disclosure, showing a ceiling placed above the lamp.
Figure 2:
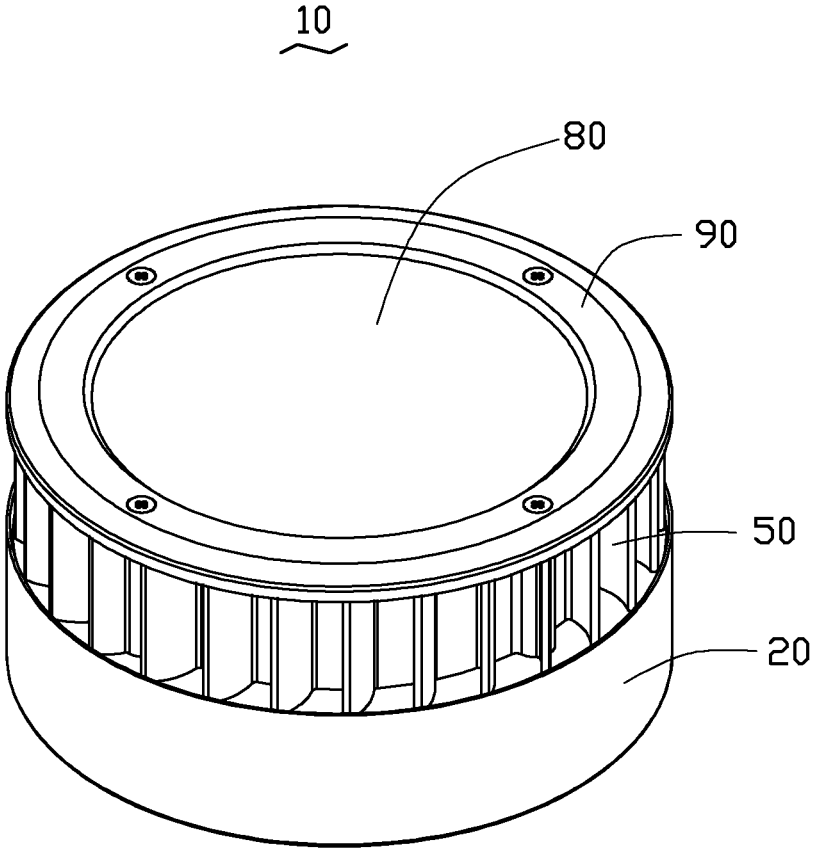
FIG. 2 is an inverted view of the lamp of FIG. 1.

Referring to FIGS. 1-2, a lamp 10 in accordance with an embodiment of the present disclosure is shown. The lamp 10 includes a lamp body 200 and a supporting body 100 connected to the lamp body 200. The supporting body 100 is for being fixed to a support 19 such as a ceiling.

Figure 3:
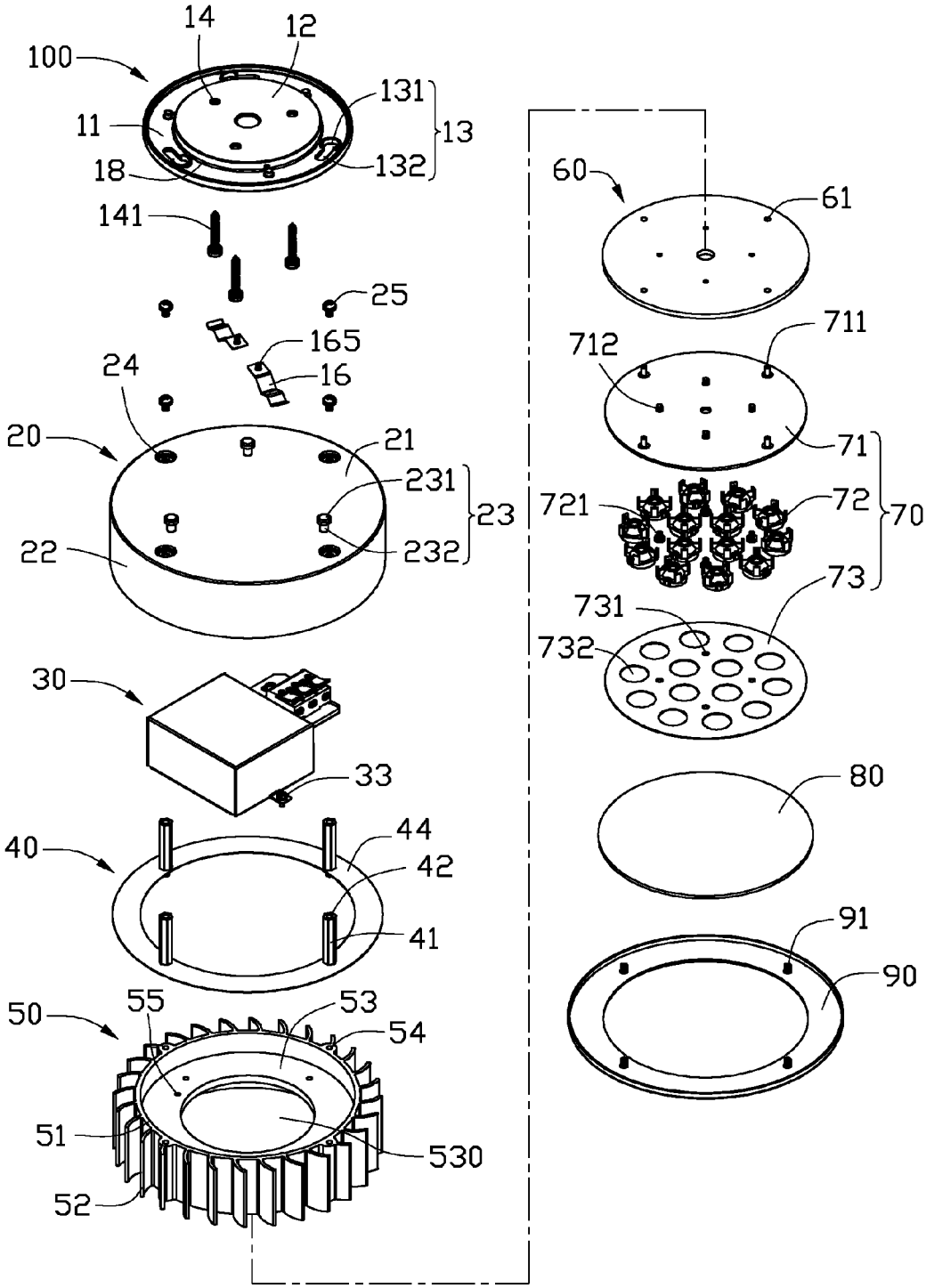
FIG. 3 is an exploded view of the lamp of FIG. 1.
Figure 4:
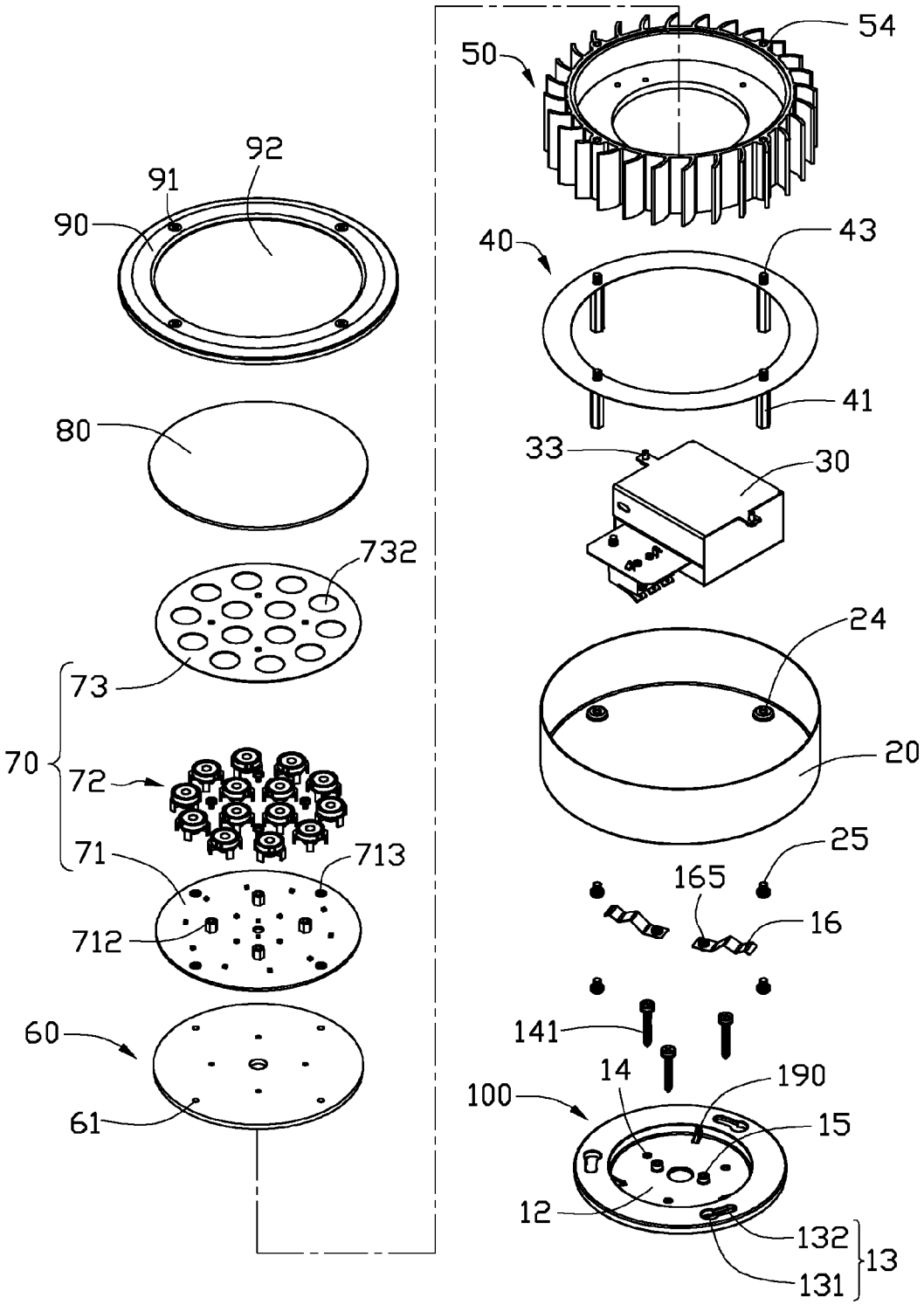
FIG. 4 is an inverted view of the lamp of FIG. 3.

Also referring to FIGS. 3-4, the lamp body 200 includes a housing 20, a driving module 30 received in the housing 20, a heat sink 50 fixed to the housing 20, a light source 70 fixed to the heat sink 50, and a cover 80 secured to the heat sink 50 to cover the light source 70.

The housing 20 is made of metal such as aluminum or copper. The housing 20 includes a top plate 21 and a sidewall 22 extending downwardly from a circumferential periphery of the top plate 21. The top plate 21 defines four holes 24 adjacent to the circumferential periphery thereof. Three protrusions 23 extend upwardly from a top face of the top plate 21. Each protrusion 23 includes a pole 232 connected to the top plate 21 and a head 231 formed on a top end of the pole 232. The head 231 has a diameter larger than that of the pole 232. The driving module 30 is received in the housing 20 and surrounded by the sidewall 22.

The heat sink 50 is made of heat conductive materials such as aluminum or copper. The heat sink 50 includes an annular base 53, an outer wall 51 formed on an outer circumferential periphery of the base 53 and a plurality of curved fins 52 extending radially from an outer circumferential face of the outer wall 51. The base 53 defines an opening 530 in a central area thereof and a plurality of holes 55 surrounding the opening 530. The driving module 30 is fixed on the base 53 by extending screws 33 through two tabs (not labeled) thereof into some of the holes 55 of the base 53. The outer wall 51 is perpendicular to the base 53. The base 53 is connected to a middle of an inner circumferential face of the outer wall 51 whereby the base 53 generally divides the outer wall 51 into an upper portion and a lower portion. The upper portion extends upwardly beyond the base 53 and the lower portion extends downwardly beyond the base 53. Four posts 54 are axially formed on the outer circumferential face of the outer wall 51. Each post 54 connects a corresponding fin 52. The four posts 54 are perpendicular to the base 53. Each post 54 defines a hole (not labeled) therein corresponding to the hole 24 of the top plate 21 of the housing 20.

A connection element 40 is provided between the housing 20 and the heat sink 50. The connection element 40 includes an annulus 44 and four poles 41 extending upwardly from a top face of the annulus 44. The four poles 41 are aligned with the four posts 54 of the heat sink 50, respectively. Each pole 41 defines a through hole 42 in a top portion thereof. Screws 25 extend through the holes 24 of the cover 20 into the holes 42 of the poles 41 of the connection element 40 correspondingly to fix the cover 20 to the connection element 40. Each pole 41 further forms a threaded end 43 protruding downwardly through the annulus 44. The threaded ends 43 of the poles 41 are engaged in top portions of the holes of the posts 54, thereby fixing the heat sink 50 to the connection element 40. Therefore, the heat sink 50 and the housing 20 are fixed together through the connection element 40.

A heat conduction plate 60 is placed within the heat sink 50 to conduct heat generated from the light source 70 to the heat sink 50. The heat conduction plate 60 can be made of materials similar to that of the heat sink 50. The heat conduction plate 60 is circular, and defines four holes 61 adjacent to a circumferential periphery thereof. The four holes 61 have one-to-one corresponding relationships with respect to the four holes 55 of the base 53 of the heat sink 50. The heat conduction plate 60 contacts a bottom face of the base 53 and is surrounded by the outer wall 51 of the heat sink 50.

The light source 70 includes a printed circuit board 71, a plurality of LEDs (not labeled) received in a plurality of lenses 72 and a pressing plate 73 fixed on the printed circuit board 71. The printed circuit board 71 has a shape similar to that of the heat conduction plate 60. Four screws 713 are provided to extend through the printed circuit board 71 and one-to-one align with the four holes 61 of the heat conduction plate 60. Each of the screws 713 has a threaded end 711. The threaded end 711 of each screw 713 extends through a corresponding one of the holes 61 of the heat conduction plate 60 into a corresponding one of the holes 55 of the base 53 of the heat sink 50, thereby fixing the printed circuit board 71 and the heat conduction plate 60 to the heat sink 50. The printed circuit board 71 is electrically connected to the driving module 30. Four nuts 712 protrude downwardly from a bottom face of the printed circuit board 71. The four nuts 712 are located more adjacent to a center of the printed circuit board 71 compared with the screws 713. The LEDs are mechanically and electrically connected to the printed circuit board 71. The LEDs can be driven by the driving module 30 to emit light. The lenses 72 cover the LEDs to collimate light emitted from the LEDs to a desired pattern.

The pressing plate 73 is circular, and has a diameter similar to that of the printed circuit board 71 and the heat conduction plate 60. The pressing plate 73 defines a plurality of openings 732 one-to-one corresponding to the lenses 72. An upper portion of each lens 72 extends through a corresponding one of the openings 732 to be exposed out of the pressing plate 73. A lower portion of each lens 72 is pressed by the pressing plate 73 upwardly towards the printed circuit board 71. The pressing plate 73 further defines four holes 731 one-to-one corresponding to the nuts 712 of the printed circuit board 71. A screw 721 is provided to extend through each of the holes 731 of the pressing plate 73 into a corresponding one of the nuts 712 of the printed circuit board 71 to fix the pressing plate 73 on the printed circuit board 71. The pressing plate 73 may have a reflective coating formed on a bottom face thereof for reflecting light emitted from the LEDs towards the cover 80.

The cover 80 is secured on the pressing plate 73 via a fixing element 90. The fixing element 90 has a ring-like shape with a window 92 defined in a central area thereof. A screw 91 is provided to extend through the fixing element 90 into a lower portion of the hole of each post 54 of the heat sink 50, thereby fixing the fixing element 90 to the heat sink 50. The cover 80 is circular, and made of transparent materials such as epoxy or glass. The cover 80 is pressed by the fixing element 90 on a bottom of the outer wall 51 of the heat sink 50 to cover the light source 70. The window 92 is blocked by the cover 80, whereby foreign article such as dust or rainwater cannot enter the lamp 10 through the window 92.

Figure 5:
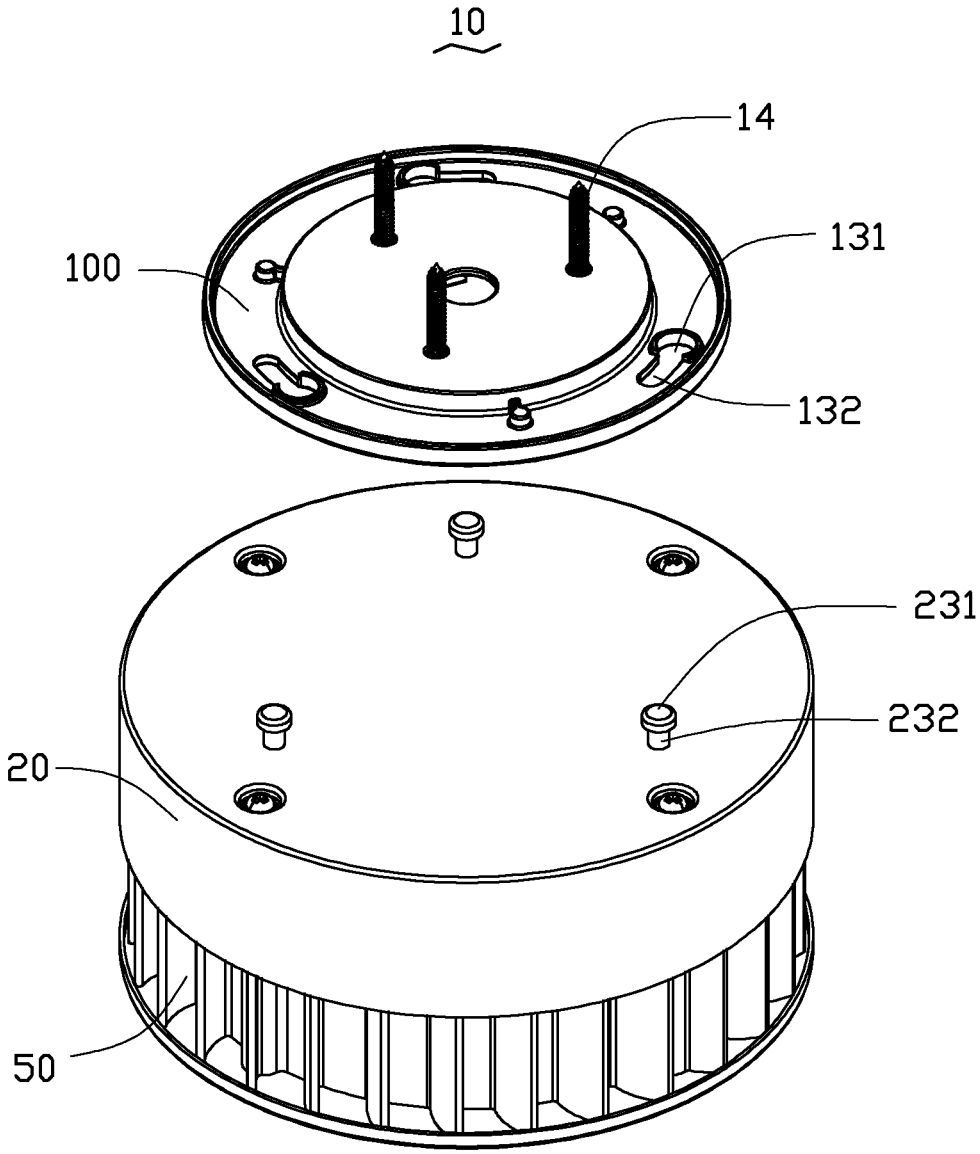
FIG. 5 is a partially, exploded view of the lamp of FIG. 1.
Figure 6:
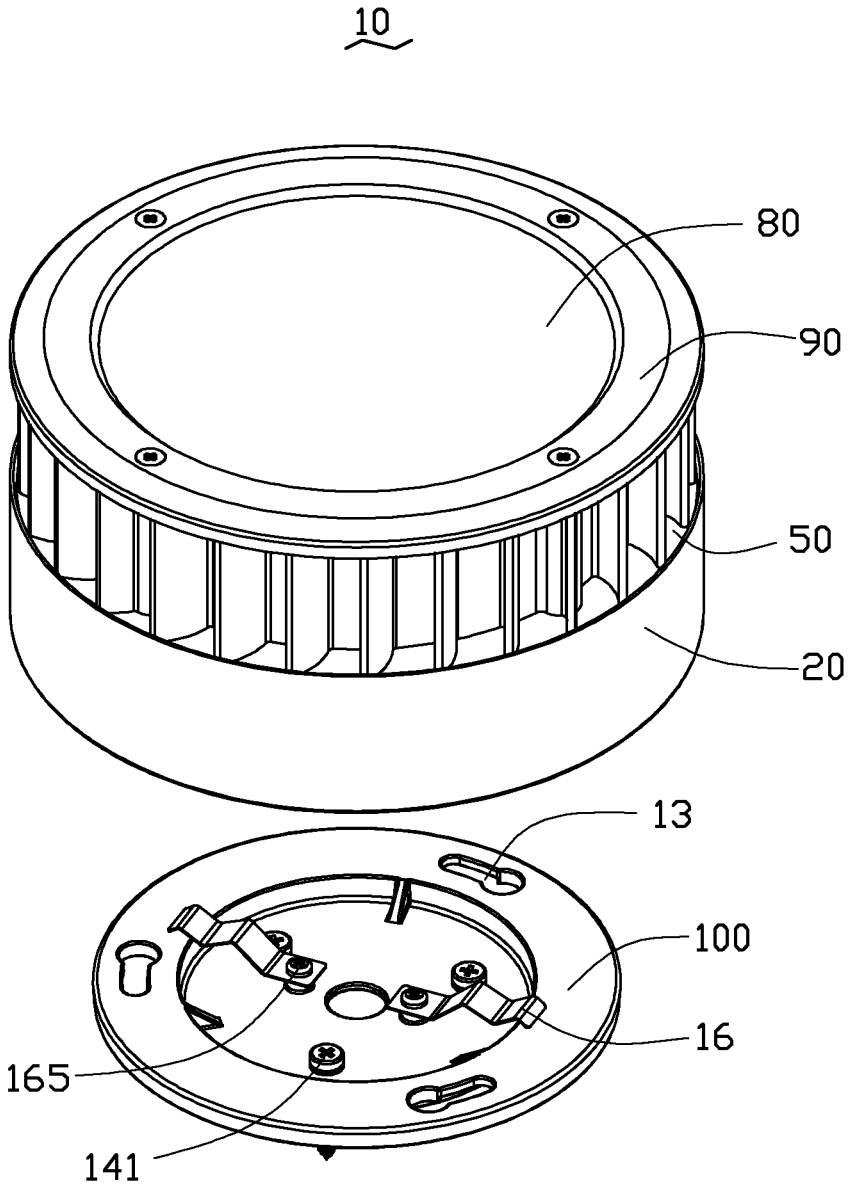
FIG. 6 is an inverted view of the lamp of FIG. 5.

The supporting body 100 includes a panel 12, a sidewall 18 extending downwardly from a circumferential periphery of the panel 12 and an annular plate 11 extending horizontally and outwardly from a bottom of the sidewall 18. The panel 12 defines three holes 14 adjacent to the circumferential periphery thereof. A screw 141 is provided to extend through each of the holes 14 of the panel 12 into the support 19 to fix the supporting body 100 to the support 19. The panel 12 forms two seats 15 protruding downwardly from a bottom face thereof. Each of the two seats 15 has a height less than that of the sidewall 18. A plurality of ribs 190 connect an inner circumferential face of the sidewall 18 with the bottom face of the panel 12 to reinforce the supporting body 100. The annular plate 11 is parallel to the panel 12 and the top plate 21 of the housing 20. The annular plate 11 defines three apertures 13 around the sidewall 18. Also referring to FIGS. 5-6, each aperture 13 includes a hole 131 and a slot 132 in communication with the hole 131. The hole 131 is circular, and has a diameter larger than a width of the slot 132. The diameter of the hole 131 is larger than that of the head 231 of the protrusion 23. The width of the slot 132 is larger than the diameter of the pole 232 and less than the diameter of the head 231 of the protrusion 23. In assembly of the housing 20 to the supporting body 100, each of the protrusions 23 is firstly inserted into the hole 131 of a corresponding one of the apertures 13. The housing 20 is then rotated along the apertures 13 to drive the poles 232 to slide out of the holes 131 and into the slots 132. When the poles 232 move into the slots 232, the heads 231 abut against areas of a top face of the annular plate 11 around the slots 132, whereby the lamp body 200 is connected to and can be hung by the supporting body 100. The supporting body 100 further includes two tabs 16 fixed on the panel 12. Each tab 16 is bended plural times to become elastically-deformable. Each tab 16 has an end fixed on the panel 12 by extending a screw 165 therethrough into a corresponding seat 15, and an opposite end abutting against a bottom face of the annular plate 11. After the lamp body 200 is connected to the supporting body 100 in a manner as disclosed above, the two tabs 16 are deformed to resiliently press the housing 20 downwardly, whereby the connection between the lamp body 200 and the support body 100 can be more stable and firm, preventing the lamp body 200 from rotation and separation from the supporting body 100 due to vibration or shock happened to the lamp 10 when the lamp 10 is hung to the support 19.

When the lamp 10 is required to mount to the support 19, the supporting body 100 can be fixed to the support 19 beforehand by having the three screws 141 extending through the holes 14 and engaging into the support 19. The lamp body 200 is then hung on the supporting body 100 by locking the housing 20 with the supporting body 100. The locking of the housing 20 with the supporting body 100 is simply achieved just by rotating the protrusions 23 into the slots 132. Therefore, the whole assembly process of the lamp 10 is convenient and labor-saving.

It is believed that the present disclosure and its advantages will be understood from the foregoing description, and it will be apparent that various changes may be made thereto without departing from the spirit and scope of the present disclosure or sacrificing all of its material advantages, the examples hereinbefore described merely being preferred or exemplary embodiments.

What is claimed is:

1. A lamp comprising:

a supporting body adapted for being fixed to a support; and a lamp body comprising:

a housing;

a light source; and a cover;

wherein one of the housing and supporting body has a protrusion comprising a thin portion and a thick portion connected to the thin portion, the other one of the housing and the supporting body comprising a plate defining an aperture, the aperture comprising a wide portion and a narrow portion in communication with the wide portion, the thick portion of the protrusion having a width larger than that of the narrow portion of the aperture;

wherein the housing is operable to make the protrusion to extend through the wide portion of the aperture from a face of the plate and then slide into the narrow portion of the aperture where the thick portion of the protrusion abuts against at an opposite face of the plate, thereby mounting the lamp body to the supporting body;

wherein the supporting body comprises a panel and a sidewall extending from the panel, the sidewall interconnecting the panel and the plate; and wherein the supporting body comprises an elastically-deformable tab fixed on the panel, the tab being compressed between the housing and the supporting body.

2. The lamp of claim 1, wherein the wide portion of the aperture is a hole, and the narrow portion of the aperture is a slot, the slot having a width less than a diameter of the hole.

3. The lamp of claim 1, wherein the thin portion of the protrusion is a pole, and the thick portion is a head formed on an end of the pole.

4. The lamp of claim 1, wherein the plate surrounds the sidewall of the supporting body.

5. The lamp of claim 1, wherein the tab has an end fixed on the panel and an opposite free end abutting against the plate.

6. The lamp of claim 1, wherein the supporting body comprises a plurality of ribs connecting the panel with the sidewall.

7. The lamp of claim 1, wherein the lamp body comprises a heat sink receiving the light source therein, the heat sink being fixed to the housing via a connection element.

8. The lamp of claim 7, wherein the connection element comprises an annulus and a plurality of poles formed on the annulus, fasteners extending through the housing into the poles of the connection element, respectively.

9. The lamp of claim 8, wherein the poles are orientated perpendicular to the annulus.

10. The lamp of claim 7, wherein a driving module is received between the housing and the heat sink.

11. The lamp of claim 8, wherein the heat sink comprises a base, an outer wall extending from the base and a plurality of fins extending radially from the outer wall, the connection element being located between the housing and the heat sink.

12. The lamp of claim 11, wherein the outer wall surrounds the base, the outer wall comprising an upper portion extending upwardly beyond the base and a lower portion extending downwardly beyond the base.

13. The lamp of claim 11, wherein the heat sink comprises a plurality of posts formed on an outer circumferential face of the outer wall, the poles of the connection element having threaded ends engaged in the posts, respectively.

14. The lamp of claim 11, wherein the light source comprises a printed circuit board and a plurality of LEDs mounted on the printed circuit board, the printed circuit board being fixed to a bottom face of the base via a heat conduction plate.

15. The lamp of claim 14, wherein the light source comprises a plurality of lenses covering the LEDs and a pressing plate pressing the lenses on the printed circuit board, the pressing plate defining a plurality of openings to partially expose the lenses.

16. The lamp of claim 11, wherein the lamp body further comprises a fixing element pressing the cover against a bottom of the outer wall of the heat sink.

17. A lamp comprising:

a supporting body adapted for being fixed to a support; and a lamp body comprising:

a housing;

a light source; and a cover;

wherein one of the housing and supporting body has a protrusion comprising a thin portion and a thick portion connected to the thin portion, the other one of the housing and the supporting body comprising a plate defining an aperture, the aperture comprising a wide portion and a narrow portion in communication with the wide portion, the thick portion of the protrusion having a width larger than that of the narrow portion of the aperture;

wherein the housing is operable to make the protrusion to extend through the wide portion of the aperture from a face of the plate and then slide into the narrow portion of the aperture where the thick portion of the protrusion abuts against at an opposite face of the plate, thereby mounting the lamp body to the supporting body;

wherein the supporting body comprises a panel and a sidewall extending from the panel, the sidewall interconnecting the panel and the plate; and wherein the supporting body comprises a plurality of ribs connecting the panel with the sidewall.

18. A lamp comprising:

a supporting body adapted for being fixed to a support; and a lamp body comprising:

a housing;

a light source; and a cover;

wherein one of the housing and supporting body has a protrusion comprising a thin portion and a thick portion connected to the thin portion, the other one of the housing and the supporting body comprising a plate defining an aperture, the aperture comprising a wide portion and a narrow portion in communication with the wide portion, the thick portion of the protrusion having a width larger than that of the narrow portion of the aperture;

wherein the housing is operable to make the protrusion to extend through the wide portion of the aperture from a face of the plate and then slide into the narrow portion of the aperture where the thick portion of the protrusion abuts against at an opposite face of the plate, thereby mounting the lamp body to the supporting body;

wherein the lamp body comprises a heat sink receiving the light source therein, the heat sink being fixed to the housing via a connection element; and wherein the connection element comprises an annulus and a plurality of poles formed on the annulus, fasteners extending through the housing into the poles of the connection element, respectively.

* * * * *